United States Patent [19]

Ueda

[11] Patent Number: 5,043,193

[45] Date of Patent: Aug. 27, 1991

[54] DECORATION TREE

[76] Inventor: Hiroshi Ueda, 3-16, Imai 3-Chome, Ome-Shi, Tokyo, Japan

[21] Appl. No.: 553,665

[22] Filed: Jul. 18, 1990

[51] Int. Cl.[5] ..... A47G 33/06

[52] U.S. Cl. ..... 428/18; 362/84; 362/123; 428/690

[58] Field of Search ..... 428/18, 19, 20, 690; 362/84, 122, 123

[56] References Cited

U.S. PATENT DOCUMENTS

| | | | |
|---|---|---|---|
| 2,738,616 | 3/1956 | Windle | 428/13 X |
| 4,364,102 | 12/1982 | Huppert et al. | 428/18 X |
| 4,536,656 | 8/1985 | Sowa | 362/84 X |
| 4,891,505 | 1/1990 | Jalon | 428/690 X |
| 4,921,462 | 5/1990 | Lovik | 428/12 X |

*Primary Examiner*—Henry F. Epstein
*Attorney, Agent, or Firm*—Fred Philpitt

[57] ABSTRACT

A tree model is made of synthetic resin and surfaces of stem portion, branch portions and leaves of the tree model are covered with a green light emitting inorganic phosphor and additional decoration models to be mounted on the branch portions or leaves of the tree model are made of synthetic resin and are formed in a variety of models of various kinds of goods such as furits, bells and the like and the surfaces of the various models are covered with an inorganic phosphor emitting a variety of colors consisting of at least one kind chosen from a red light emitting phosphor, green light emitting phosphor and blue light emitting phosphor and these tree model and the additional decoration models are seen as white under the visible rays of light but the inorganic phosphor emits light when irradiated with ultraviolet rays, and the light emitting is taken place with color in red, green, blue, yellow, pink or orange according to kinds of the inorganic phosphor applied on the tree model and the additional decoration models, and under the visible rays of light and the irradiation of the ultraviolet rays, the same decoration goods show the entirely different colors which produce an interesting phenomenon of the colors to the viewers.

11 Claims, 3 Drawing Sheets

DECORATION TREE

BACKGROUND OF THE INVENTION

This invention relates to decoration tree to be used primarily for indoor decoration consisting of tree, and more particularly to the decoration tree consisting of a tree model being made of synthetic resin and consisting of stem portion, branch portions and leaves and the surfaces thereof being covered with a green light emitting inorganic phosphor emitting light in a green color upon receiving the ultraviolet rays on the surfaces of the stem portion, branch portions and the leaves, additional decoration models being made of synthetic resin and consisting of a variety of models formed of various kinds of goods and their surfaces being covered with an inorganic phosphor emitting light in a variety of colors consisting of at least one kind chosen from a red light emitting inorganic phosphor emitting light upon receiving the ultraviolet rays and a green light emitting inorganic phosphor emitting light upon receiving the ultraviolet rays and a blue light emitting inorganic phosphor emitting light upon the receiving ultraviolet rays, and an ultraviolet ray bulb disposed at a position where irradiation can be applied to the tree model and the various additional decoration models of variety of kinds of goods.

Heretofore, the decoration tree for indoor decoration was such that the natural gree or the mimic tree was planted in a flowerpot and the flowerpot was placed on the floor of the room, and a variety of additional decoration models were mounted on the branches or leaves of the tree or a plurality of miniature bulbs were mounted thereon to enhance the decoration effect which were well known to the users.

One of the most typical decoration trees of the foregoing description was a Christmas tree. Namely, the Christmas tree was planted in a flowerpot and this flowerpot was placed on the floor of the room, and the cotton resembling the snow was mounted on the branches or leaves or a variety of additional decoration models such as the moon, stars, bells, Santa Claus, doll, socks and the like were suspended on the branches or leaves, and moreover, a plurality of miniature bulbs emitting lights in various colors such as red, orange, yellow, pink, blue and the like were suspended over the branches or leaves to enhance the decoration effect which were well known to the users.

However, when the illumination in the room was darkened in order to enhance the light emitting effect of the miniature bulbs provided on the decoration tree, the tree and the additional decoration models mounted on the tree did not appeal to the viewers, and when the illumination in the room was brightened, the light emitting effect of the miniature bulbs was lowered which were the drawbacks.

Also, for example, it was considered that the organic fluourescent pigment such as red, yellow and the like was applied to the surface of the decoration and this decoration was excited by the irradiation of the ultraviolet rays in the dark environment whereby the color emission was taken place.

However, since the color seen under the visible rays of light and the color seen upon the irradiation of the ultraviolet rays were the same, it was impossible to expect to getting more color producing effect identical with the case where the light by ordinary illuminating unit is applied even through there was a certain color producting effect of light emitting by the decoration on account of the irradiation of the ultraviolet rays without irradiating the ultraviolet rays specifically by applying the fluorescent pigment. Namely, there is no interesting phenomenon that the decoration transforms with entirely different colors under the visible rays of light and the irradiation of the ultraviolet rays such as the decoration shows the white under the visible rays of light but when it is irradiated with the ultraviolet rays, the color emission with a color such as red, pink, yellow, green, blue and the like.

SUMMARY OF THE INVENTION

An object of this invention is to provide a decoration tree having a performance of emitting light on the surface of the decoration by applying an inoraganic phosphor that emits light upon receiving the ultraviolet rays over the decoration, namely, the tree model and the additional decoration models mounted on the tree model, and as a result, each goods of the decoration placed in the dark room produces individually clear color.

Another object of this invention is to provide a decoration tree capable of emitting light in a desired color such as red, green, blue, yellow, pink, orange and the like which is emitted by the inorganic phosphor when the decoration receives the ultraviolet rays by the selection of kinds of the inorganic phosphors.

A further object of this invention is to enhance the decoration effect by arranging that when the decoration appearing white under the visible rays of light is irradiated with the ultraviolet rays, it emits color of red, green, blue, yellow, pink or orange according to kinds of the inorganic phosphors applied on the decoration and the same decoration produces an entirely different color under the visible rays of light and in the irradiation of the ultraviolet rays which brings about an interesting phenomenon of transformation of colors.

A still further object of this invention is to provide an ornament on a display shelf.

A yet further object of this invention is to provide an item of a hanging-up-on-the-wall type.

DETAILED DESCRIPTION OF THE INVENTION

Figure 1:
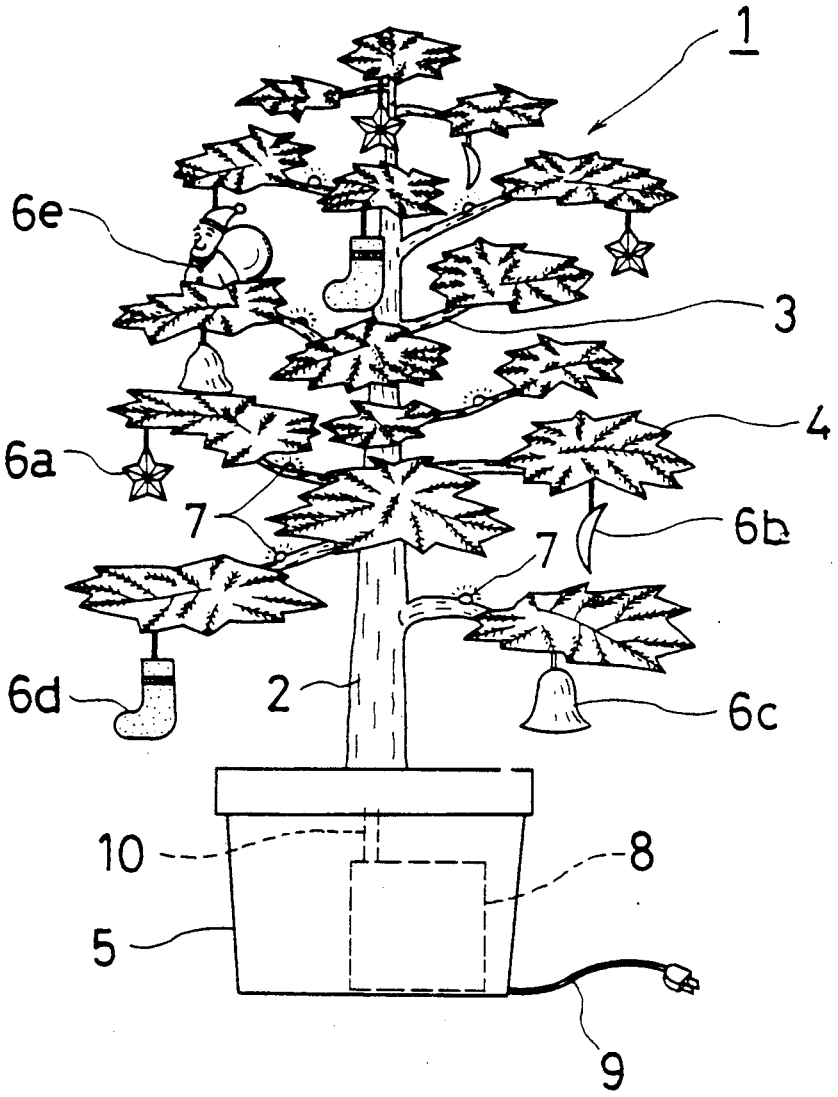
FIG. 1 is an elevation of a decoration tree according to this invention.

In FIG. 1, the tree model 1 of this invention is molded using plastics, and consisting of a stem portion 2, branch portions 3 and leaves 4, and the tree model 1 is erected in a base 5 of a flowerpot type. The stem portion 2, branch portions 3 and leaves 4 of the tree model 1 are applied with an inorganic phosphor emitting light upon receiving the ultraviolet rays. On the branch portions 3 or the leaves 4 of the tree model 1, a large number of additional decoration models of a variety of kinds of goods such as star type 6*a*, moon type 6*b*, bell model 6*c*, socks model 6*d* and doll model 6*e* like Santa Claus are suspended, or are mounted on the branches or the leaves. On the additional decoration models 6*a*–6*e* of a variety of kinds are applied with the inorganic phosphor emitting light upon receiving the ultraviolet rays similar to the tree model 1. On the required location of the stem portion 2 or the branch portions 3 of the tree model 1, a ultraviolet ray bulb 7 is provided which irradiates the branch portions 3 or the leaves 4 of the tree model 1 or the additional decoration models 6*a*–6*e* mounted on the branches or the leaves of the tree model 1.

The clause "inorganic phosphor emitting light upon receiving the ultraviolet rays" used in this invention means the substance emitting light upon receiving the ultraviolet rays of wavelength 254–400 nm; and preferably, a red light emitting inorganic phorphor (hereinafter mentioned briefly as "R phosphor") that emits light in a color phase of red upon receiving the ultraviolet rays of wavelength 254–400 nm and having a light emitting peak in the range of 600–660 nm, and a green light emitting inorganic phosphor (hereinafter mentioned briefly as "G phosphor") that emits light in a color phase of green and having a light emitting peak in the range of 490–560 nm, and a blue light emitting inorganic phosphor (hereinafter mentioned briefly as "B phosphor") that emits light in a color phase of blue and having a light emitting peak in the range of 390–460 nm are used.

As the R phosphor, for example, $Y_2O_3$:Eu (light emitting peak 611 nm: applicable to hereunder), $YVO_4$:Eu(619), $Y_2O_2S$:Eu(626), 3.5 MgO, 0.5 $MgF_2GeO_2$:Mn(660) (Y.Gd)$BO_5$:Eu(611) and the like may be enumerated. These substances are used as a mixture of one kind or more than two kinds of the substances.

As the G phosphor, for example, ZnS:Cu,Al(530), (Zn,Cd)S: Cu,Al(530–560), ZnS:Cu,Au,Al(535), $Zn_2SIO_4$:Mn(525), ZnS:Ag,Cu(527), (Zn,Cd)S:Cu(525), ZnS:Cu(530), $Gd_2O_2S$:Tb(544), $La_2O_2S$:Tb(544), $Y_2SIO_5$:Ce,Tb(544), $Zn_2Ge_4$:Mn(533), $CeMgAl_{11}O_{19}$:Tb(543), $SrGa_2S_4$:$Eu^{2+}$(535), ZnS:Cu,CO(516), $MgO._nB_2O_3$:Ce,Tb(544), LaOBr:Tb,Tm(544), $La_2O_2S$:Tb(544) and the like can be enumerated. These substances are used as a mixture of one kind or more than two kinds of the substances.

As the B phosphor, ZnS:Ag(450), $CaWO_4$(425), $Y_2SIO_5$:Ce(410), ZnS:Ag,Ga,Cl(450), $Ca_2B_5O_9Cl$:$Eu^{2+}$(450), $BaMgAl_{14}O_{23}$:$Eu^{2+}$(454) and the like can be enumerated. These substances are used as a mixture of one kind or more than two kinds of the substances.

The foregoing R phosphor, G phosphor and B phosphor show white as the reflection color in the visible rays of light, namely, under the ordinary illumination such as solar rays or electric bulbs, fluorescent bulbs, but when the ultraviolet rays of longer wavelength is irradiated, the R phosphor emits in red emitting color by reacting to the ultraviolet rays, and the G phosphor emits in green emitting color by reacting to the ultraviolet rays, and the B phosphor emits in red emitting color by reacting to the ultraviolet rays. Each R phosphor, G phosphor, B phosphor is used as monochrome or if necessary, three primary colors of the R phosphor, G phosphor and B phosphor are mixed at an optional ratio, and they are used as the inorganic phosphors emitting lights of various kinds such as yellow, pink, violet and the like.

The foregoing inorganic phosphors are such that the white that is the reflection color of the inorganic phosphor coincides with the wavelength emitted from the inorganic phosphor so that it has a brightness of more than three times when compared with the conventional organic fluorescent pigments, and they not only appear extremely bright but also these light emitting colors have extremely high purity of colors, and moreover, they emit clearly drawing attention of viewers when they are dark colors, and emit in a color tone soft and refreshing to viewers when they are light colors.

The G phosphor having a color phase of green system is applied to the leaves 4 of the tree model 1, using each of the R phosphor, G phosphor and B phosphor as monochrome or using a mixture of the three primary colors of the R phosphor, G phosphor and B phosphor which are mixed at an optional ratio, and they are applied to the additional decoration models 6*a*–6*e* of a various kinds of goods by selecting the inorganic phosphors emitting fluorescent lights in red, yellow, pink, violet, blue and green according to the models of the respecive goods.

Figure 2:
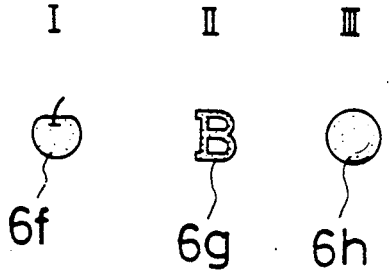
FIG. 2 is an elevation of additional decoration models of (I), (II) and (III)

Also, the additional decoration models are not limited to the goods decoration models 6*a*–6*e* enumerated in the foregoing, and the various goods models such as fruit model 6*f*, letter model 6*g*, ball model 6*h* and the like as shown in FIG. 2(I)–(III) may be provided, and these models 6*f*–6*h* may be provided by selecting one color out of the inorganic phosphors emitting fluorescent colors in red, yellow, pink, violet, blue and green.

A black right emitting long wavelength ultraviolet ray of 250–400 nm is used as the ultraviolet ray bulb.

The ultraviolet ray bulb 7 is lighted on by a control unit 8 built in the base 5 as shown in FIG. 1. The control unit 8 is connected to a power source by means of a cord 9 on one hand and is connected to a socket 11 for ultraviolet ray bulb 7 imbedded in the stem portion 2 or the branch portions 3 by means of a cord 10 on the other hand.

Figure 3:
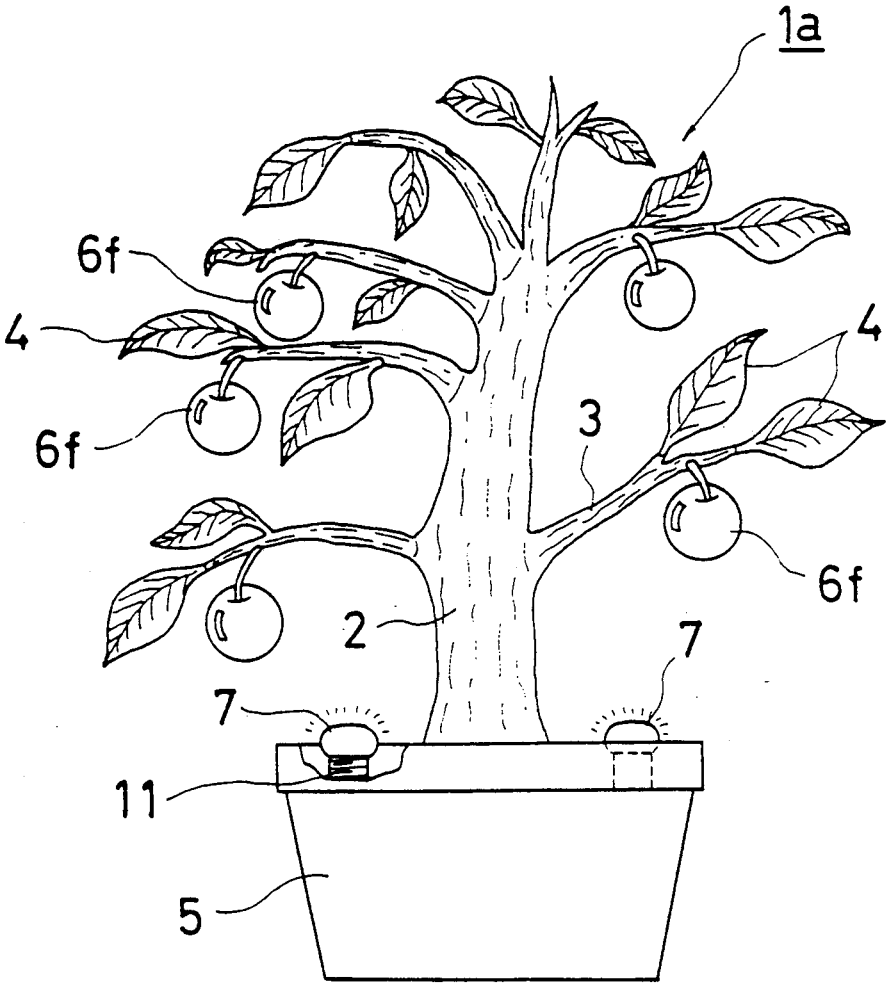
FIG. 3 is an elevation of a decoration tree of another embodiment.

FIG. 3 shows a tree model 1*a* prepared by forming the fruit model 6*f* integrally on the branch portion 3, and in this embodiment, the socket 11 for installation of the ultraviolet ray bulb 7 is installed on the base 5 and is connected to the power source by means of the control unit 8.

In either case of FIG. 1 and FIG. 3, the irradiation of the ultraviolet ray bulb 7 is directed toward the additional decoration models 6*a*–6*h*.

However, the foregoing inorganic phosphor is applied directly to the surface of the stem portion 2, branch portions 3 and leaves 4 of the tree model 1. Similarly, the various additional decoration models 6*a*–6*h* are applied directly with the inorganic phosphor. But, it is feasible to mold the tree models 1, 1*a* and the various additional decoration models 6*a*–6*h* by mixing the inorganic phosphor in the synthetic resin.

Since the decoration tree according to this invention is applied with the inorganic phosphor emitting light upon receiving the ultraviolet rays on the tree model 1 and the various additional decoration models 6*a*–6*h*, these models 1 and 6*a*–6*h* have the performance of emitting light by themselves. These models 1 and 6*a*–6*h* appear white that is the reflection color under the solar ray or the electic bulbs or the fluorescent lights and emit in one color among the red, yellow, orange, pink, violet, blue or green according to the kinds of the inorganic phosphors. The reflection color of the inorganic phosphor coincides with the wavelength of the fluorescent light to emit light in the brightness of more than three times of the ordinary fluorescent pigment so that it appears extremely bright or the emitting color is of an extremely high purity of color when emitting by reacting to the ultraviolet rays, and moreover, it emits in bright color drawing the attention of the viewer when it is the dark color, and emits in color tone soft and refreshing to the viewer when it is the light color.

The inorganic phosphor produces the delicate difference in colors by the difference of the light emitting peak.

Figure 4:
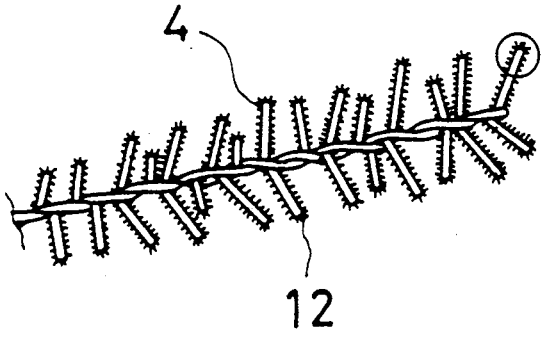
FIG. 4 is a perspective view of essential part showing that pile is planted.
Figure 5:
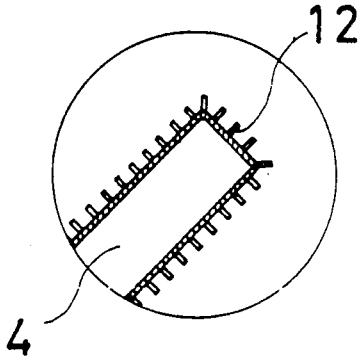
FIG. 5 is a cross section of enlarged essential part shown in FIG. 4.

Also, as shown in FIG. 4 and FIG. 5, the piles 12 are embedded on the surfaces of the stem portion 2, branch portions 3 and leaves 4 of the tree model 1 and the various additional decoration models 6*a*–6*h*, and the coating area of the inorganic phosphor is increased and then the inorganic phosphor emitting light upon receiving the ultraviolet rays may be coated on these piles 12.

Figure 6:
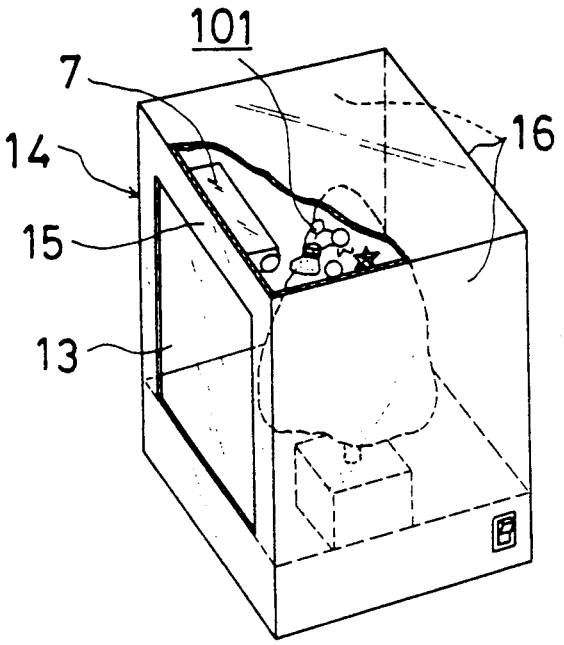
FIG. 6 is a perspective view of a decoration tree formed as an ornament.
Figure 7:
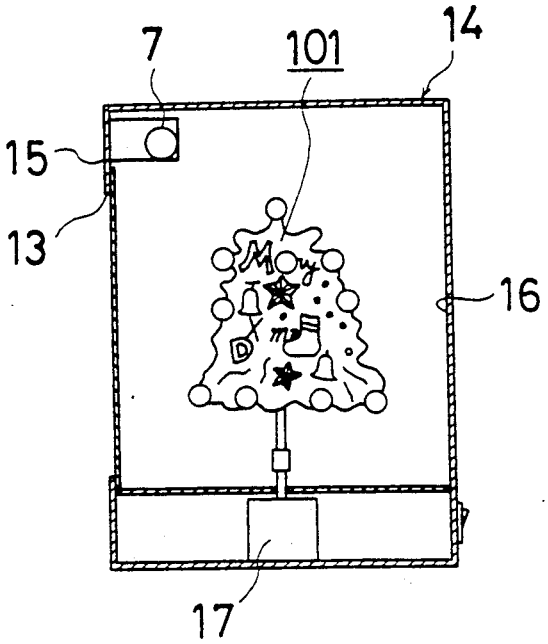
FIG. 7 is a vertical cross section side view of FIG. 6.

In FIG. 6 and FIG. 7, the case 17 formed in box type which has the open surface 13 on its front surface is provided, and on the other hand, a small size tree model 101 is formed and the G phosphor emitting light in green color applied on the tree model 101, and the tree model 101 is accommodated in the case 14, and the ultraviolet ray bulb 7 is installed on the inner wall 15 of the upper edge of the open surface 13 of the case 14 so that the tree model 101 is irradiated, and is formed as an ornament to be decorated on top of the display shelf.

The case 14, as shown in FIG. 7, has the three side walls 16 as the mirror surfaces, and a motor 17 is disposed on its bottom surface to make the tree model 101 rotatable.

Figure 8:
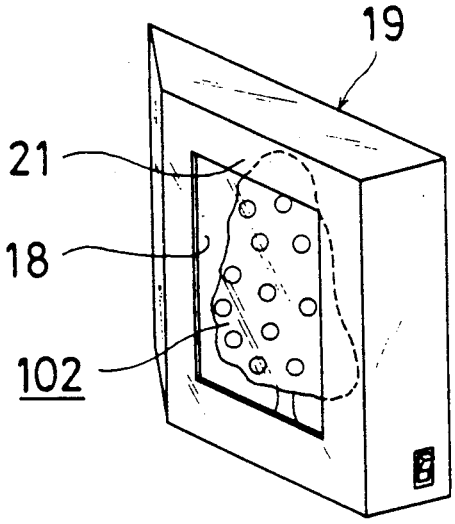
FIG. 8 is a perspective view of a decoration tree formed as an item of a hanging-up-on-the-wall type.
Figure 9:
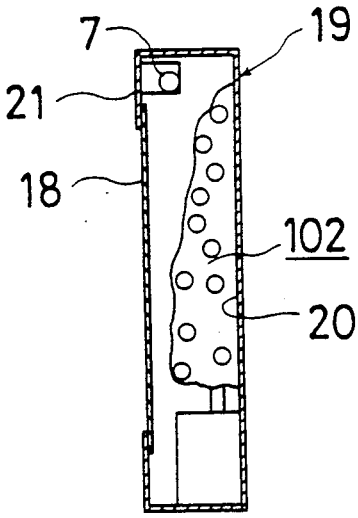
FIG. 9 is a vertical cross section side view of FIG. 8.

In FIG. 8 and FIG. 9, a picture frame like case 19 having an open surface 18 on its front surface is provided, and a tree model 102 is formed in a half-body, and the G phosphor emitting in green is applied on the surface of the tree model 102, and the tree model 102 is fixed to the rear surface 20 of the case 19, and the ultraviolet bulb 7 for irradiating the tree model 101 is installed on the inner wall 21 of the upper edge of the open surface 18 of the case so that it can be formed as a hanging-up-on-the-wall type.

Accordingly, a decoration tree is provided in which the tree model and the various additional decoration models are applied with the inorganic phosphor emitting light upon receiving the ultraviolet rays and thus, these models have performance of emitting light by themselves, and the inorganic phosphor having one hue of red, yellow, orange, pink, violet, blue or green is selected, and for example, the inorganic phosphor emitting in the hue of green is applied on the tree model, and the inorganic phosphor emitting in the hue of orange or yellow is applied to the additional decoration models such as the bell, stars, moon and the like, and the inorganic phosphor emitting in the hue of red or pink is applied to the letter model or the ball model, and the various additional decoration models emitting in the various hues are mounted on the tree model so that when the ultraviolet rays are irradiated, the respective goods models are excited to the ultraviolet rays to emit in the various colors whereby remarkable color producing effect can be provided. The inorganic phosphor emitting light upon receiving the ultraviolet rays emits light with a brightness more than three times of the conventional ordinary fluorescent pigments which coincides with the wavelength of the ultraviolet rays, and it appears extremely bright, and also, when the emission is taken place by reacting to the ultraviolet rays, the light emitting color is of extremely high purity color, and moreover, it emits in a bright color drawing the attention of the viewers when the pigment is in the dark color, and emits light in a color tone soft and refreshing to the viewers when the pigment is in the light color so that the color producing effect is highly enhanced. Moreover, when the individual additional decoration models are disposed in the dark location, they emit light like the individual neons by reacting to the ultraviolet rays drawing the attention of the viewers to the models. Therefore, the models demonstrate the color producing effect beyond the comparison with the conventional decoration trees. Moreover, each kind of the models appears white under the visible rays they emit colors bearing the red, green, blue, pink, yellow, violet and the like and thus, the viewers can enjoy strangeness of the transformation of the colors when they are seen under the visible rays of light and are irradiated with the ultraviolet rays.

What is claimed is:

1. A decorative display in the form of a tree, said display comprising (a) a stem or trunk portion, (b) a plurality of branch portions extending outwardly from said stem or trunk portion, (c) leaf portions affixed to said branch portions, (d) at least one source of ultra-violet rays directed toward at least one of the aforesaid portions, and (e) a light emitting inorganic phosphor material incorporated within or on at least one of the aforesaid portions, whereby the ultra-violet rays emitted by said source (d) will cause at least one of said (a), (b) or (c) portions to emit at least one color selected from the group consisting of red, pink, orange, yellow, green and blue.

2. A decorative display according to claim 1 wherein said stem or trunk portion, said branch portions and said leaf portions are made from a synthetic resin.

3. A decorative display according to claim 1 wherein decorative items are also attached to said tree and a light emitting inorganic phosphor is also incorporated within or on such decorative items.

4. A decorative display according to claim 1 wherein said at least one source of ultra-violet rays is incorporated in said branch portions of the tree.

5. A decorative display according to claim 1 wherein said tree is surrounded by a housing and said at least one source of ultra-violet light rays is located in said housing at a spaced distance away from said tree.

6. A decorative display according to claim 3, wherein the leaf portions and the stem portion contain a green light emitting phosphor and said decorative items contain a red, pink, orange, yellow, green or blue phosphor.

7. A decorative display according to claim 6 in which the red light emitting inorganic phosphor emits light with the ultraviolet rays of the wavelength 254–400 nm and the light emitting peak is in the range of 600–660 nm.

8. A decorative display according to claim 1 in which the green light emitting inorganic phosphor emits light with ultraviolet rays of the wavelength 254–400 nm and the light emitting peak is in the range of 490–560 nm.

9. A decorative display according to claim 1 in which the blue light emitting inorganic phosphor emits light with ultraviolet rays of the wavelength 254–400 nm and the light emitting peak is in the range of 390–460 nm.

10. A decorative display according to claim 1 which includes a box-like housing surrounding the tree which has an opening on its front side, the tree being applied with a green color emitting inorganic phosphor, and the source of ultra-violet rays is a bulb located on the inner wall adjacent the upper edge of the opening of the housing.

11. A decorative display according to claim 1 wherein the tree is surrounded by a housing which has an opening on its front side, the tree resembles half a tree which is affixed to the rear wall of the housing and the source of the ultra-violet rays is a bulb located on the inner wall adjacent the upper edge of the opening of the housing.

* * * * *